US007543683B2

(12) United States Patent
Lewis et al.

(10) Patent No.: US 7,543,683 B2
(45) Date of Patent: Jun. 9, 2009

(54) VEHICLE RESONATOR STRUCTURE AND ATTACHMENT METHOD

(75) Inventors: Joel Lewis, Troy, UT (US); Jacob W. Weaver, Marysville, OH (US)

(73) Assignee: Honda Motor Co., Ltd., Tokyo (JP)

( * ) Notice: Subject to any disclaimer, the term of this patent is extended or adjusted under 35 U.S.C. 154(b) by 41 days.

(21) Appl. No.: 11/939,161

(22) Filed: Nov. 13, 2007

(65) Prior Publication Data

US 2009/0114476 A1 May 7, 2009

Related U.S. Application Data

(60) Provisional application No. 60/985,873, filed on Nov. 6, 2007.

(51) Int. Cl.

| | |
|---|---|
| ***F02M 35/00*** | (2006.01) |
| ***F01N 1/00*** | (2006.01) |
| ***F01N 1/08*** | (2006.01) |
| ***F01N 7/16*** | (2006.01) |

(52) U.S. Cl. ..... 181/229; 181/246; 181/255; 181/272; 123/184.21

(58) Field of Classification Search ..... 181/229, 181/272, 246, 255; 123/184.21
See application file for complete search history.

(56) References Cited

U.S. PATENT DOCUMENTS

| | | | | |
|---|---|---|---|---|
| 5,424,494 | A * | 6/1995 | Houle et al. | 181/229 |
| 5,756,945 | A * | 5/1998 | Maeda et al. | 181/272 |
| 5,900,595 | A * | 5/1999 | Akima et al. | 181/229 |
| 6,209,503 | B1 * | 4/2001 | Komada et al. | 123/184.56 |
| 6,382,161 | B1 * | 5/2002 | Alex et al. | 123/184.53 |
| 6,622,680 | B2 * | 9/2003 | Kino et al. | 123/184.21 |
| 6,705,272 | B2 * | 3/2004 | Leipelt et al. | 123/198 E |
| 6,938,728 | B2 | 9/2005 | Chae et al. | |
| 2004/0007197 | A1 * | 1/2004 | D. Hellie et al. | 123/184.57 |
| 2004/0040527 | A1 * | 3/2004 | Murphy | 123/184.21 |
| 2004/0118371 | A1 * | 6/2004 | Kino et al. | 123/184.42 |
| 2004/0226531 | A1 * | 11/2004 | Kino et al. | 123/184.21 |
| 2006/0048740 | A1 * | 3/2006 | Tanikawa et al. | 123/184.61 |

(Continued)

FOREIGN PATENT DOCUMENTS

| | | |
|---|---|---|
| JP | 5077321 | 3/1993 |

(Continued)

*Primary Examiner*—Jeffrey Donels
*Assistant Examiner*—Christina Russell
(74) *Attorney, Agent, or Firm*—Cermak Kenealy Vaidya & Nakajima LLP

(57) ABSTRACT

A vehicle resonator structure and attachment method is provided and includes a resonator chamber that has a first intake tube and a first exhaust or outlet tube attached thereto. At least one of the tubes includes a projection that can be molded (e.g., via flash molding after the tube itself is blow molded) onto the tube. The resonator chamber can include upper and lower tube mount structures that can be hot plate welded and sandwiched onto the projection in the tube. Thus, the tube(s) is/are positively retained in position with respect to the resonator chamber such that the tuning of the resonator does not change due to fluctuations in geometry of the tube(s) and resonator chamber structure, and such that there is little or no vibration noise and/or possible damage that might result if the tube(s) were free to move with respect to the resonator chamber.

20 Claims, 4 Drawing Sheets

U.S. PATENT DOCUMENTS

2007/0251392 A1* 11/2007 Tschech et al. ..... 96/147

FOREIGN PATENT DOCUMENTS

| | | |
|---|---|---|
| JP | 8309883 | 11/1996 |
| JP | 8338330 | 12/1996 |
| JP | 2000110543 | 4/2000 |
| JP | 2004044562 | 2/2004 |
| JP | 2006183565 | 7/2006 |
| WO | WO98/49440 | 11/1998 |

* cited by examiner

VEHICLE RESONATOR STRUCTURE AND ATTACHMENT METHOD

This application and invention claims the priority benefit under 35 U.S.C. §119 of U.S. Provisional Patent Application No. 60/985,873 filed on Nov. 6, 2007, which is hereby incorporated in its entirety by reference.

BACKGROUND

1. Field

The presently disclosed subject matter relates to a vehicle air intake system that includes a resonator and associated intake/exhaust tubes and, more particularly, to an attachment structure and method for attaching and securing an intake or other tube extending from the resonator to the resonator itself.

2. Brief Description of the Related Art

Some motor vehicles include a resonator structure located in the air induction system to eliminate undesirable noise and/or vibration associated with air passing through the induction system at various speeds. The resonator is usually located in the ductwork/tubing between the air cleaner and the throttle body/engine intake manifold.

The resonator can take many different forms, including being formed as an expansion chamber(s) and/or a Helmholtz resonator(s). A Helmholtz resonator utilizes a chamber with an open hole adjacent the air induction ductwork/tubing. The volume of air in and near the open hole vibrates because of the 'springiness' of the air inside the chamber. The vibration in the chamber occurs during air induction and when air passes through the ductwork/tubing on its way into the engine of the vehicle. This "springiness" of the air inside the chamber can be calculated and the chamber can be tuned such that the resulting resonance of chamber air acts to dampen out known vibration resonance points in the induction system. In addition, a muffler type structure, such as foam, fabrics, tube(s), or other damper structure/material can be located in the resonator chamber to muffle or absorb certain vibration resonances from the induction system.

In another type of resonator, the air induction system includes an air duct, a tuning tube supported by the air duct, and a resonance chamber that engages the air duct at an attachment interface. During assembly, the tuning tube is inserted through an opening in the resonance chamber such that a distal end of the tuning tube is positioned inside the resonance chamber. A weld area is formed at the attachment interface to securely attach the air duct to the resonance chamber.

In any of the above described (and other) resonator structures, the intake, exhaust and other tubing connected to the resonator is typically restrained from moving relative to the resonator for various reasons, including ensuring that the system is properly tuned, preventing structural damage due to vibration of the tubing or connected structures, preventing noise from vibration of tubing, etc. There is a long felt need to provide an attachment structure and method for connecting air intake system tubing with a resonator body in an efficient, light weight, low cost manner and with predictable and reproducible results.

SUMMARY

According to an aspect of the disclosed subject matter, a resonator assembly for an air intake system of a vehicle can include a resonator chamber that has a first port, a second port, a main body, a retainer portion of the main body, and a tube mount upper half and a tube mount lower half extending from the retainer portion of the main body. A first tube extending from the first port of the resonator chamber can include a first end and a second distal end located away from the first end. The first tube can further include an extension structure extending from a side surface of the first tube and spaced from the first port of the resonator chamber. A second tube can be provided and extends from the second port of the resonator chamber. A weld portion can be located between and include portions of the tube mount upper half, tube mount lower half, and the extension structure of the first tube, which are all melted together to form a bond between each other.

The resonator chamber main body can include an upper half and a separate lower half that is attached to the upper half to form the chamber.

The tube mount upper half can be formed to extend from the resonator chamber main body upper half, and the tube mount lower half can extend from the resonator chamber main body lower half.

The extension structure can include a lock structure having a stem portion and a bulbous portion. The tube mount upper half and tube mount lower half can be configured to form a cavity in which the bulbous portion is located.

The extension structure can be flash molded and the first tube can be formed via a blow molding process. In addition, the resonator chamber can include a Helmholtz resonator structure.

The resonator chamber can include a plurality of mounts configured for securing the resonator assembly within the vehicle. The first tube can include a bend portion that extends towards the retainer portion of the main body, and the extension structure can be configured to extend from the bend portion towards the resonator chamber main body.

The tube mount upper half and a tube mount lower half can each include a plurality of fins for dissipating heat during a welding process.

In accordance with another aspect of the disclosed subject matter, a method for securing a first tube to a resonator chamber in an air intake system for a vehicle is disclosed and can include the processes of providing a resonator chamber that includes a main body, a first port, a retainer portion located in the main body, and a tube mount upper half and a tube mount lower half extending from the retainer portion of the main body. The process can also include providing a first tube including a first end connected to the first port located in the resonator chamber, a second distal end located away from the first end, and an extension structure spaced from the first port of the resonator chamber. The method can also include heating at least one of the tube mount upper half, tube mount lower half, and extension structure, and locating the extension structure of the first tube in between the tube mount upper half and tube mount lower half. The method can also include applying pressure on at least one of the tube mount upper half, tube mount lower half, and extension structure to cause a weld to occur between at least one of the tube mount upper half, tube mount lower half, and extension structure.

The process of heating can include pressing a heated plate against at least one of the tube mount upper half, the tube mount lower half, and the extension structure, to cause the weld to occur between at least one of the tube mount upper half, tube mount lower half, and extension structure.

The method can also include locating a heating plate between the tube mount upper half and the tube mount lower half to heat adjoining surfaces of the tube mount upper half and the tube mount lower half, removing the heating plate from between the tube mount upper half and the tube mount lower half, and locating the extension structure between the tube mount upper half and the tube mount lower half, wherein applying pressure includes causing the tube mount upper half and the tube mount lower half to squeeze the extension structure therebetween to cause a hot plate weld to occur between the tube mount upper half, the tube mount lower half, and the extension structure.

The process of heating as described above can include heating all of the tube mount upper half, the tube mount lower half, and the extension structure, and can also include locating a heating plate against the extension structure.

The above described method can include providing an extension structure located between the first end and second distal end of the first tube.

In accordance with another aspect of the disclosed subject matter, a resonator assembly for an air intake system of a vehicle can include a resonator chamber that includes a first port, a main body, a retainer portion of the main body, and a tube mount upper half and a tube mount lower half extending from the retainer portion of the main body. A first tube can extend from the first port of the resonator chamber and include a first end connected to the first port of the resonator chamber and a second distal end located away from the first end. The first tube can also include an extension structure extending from a side surface of the first tube and spaced from the first port of the resonator chamber. A weld portion can be formed and include portions of the tube mount upper half, tube mount lower half, and extension structure of the first tube which are all melted together to form a bond between each other. The tube mount upper half and tube mount lower half can be hot plate welded together with the extension structure to encapsulate the extension structure between the tube mount upper half and tube mount lower half.

Still other aspects, features, and attendant advantages of the disclosed subject matter will become apparent to those skilled in the art from a reading of the following detailed description of embodiments constructed in accordance therewith, taken in conjunction with the accompanying drawings.

BRIEF DESCRIPTION OF THE DRAWINGS

The disclosed subject matter will now be described in more detail with reference to exemplary embodiments of the apparatus and method, given only by way of example, and with reference to the accompanying drawings, in which.

DETAILED DESCRIPTION OF EXEMPLARY EMBODIMENTS

Figure 1:
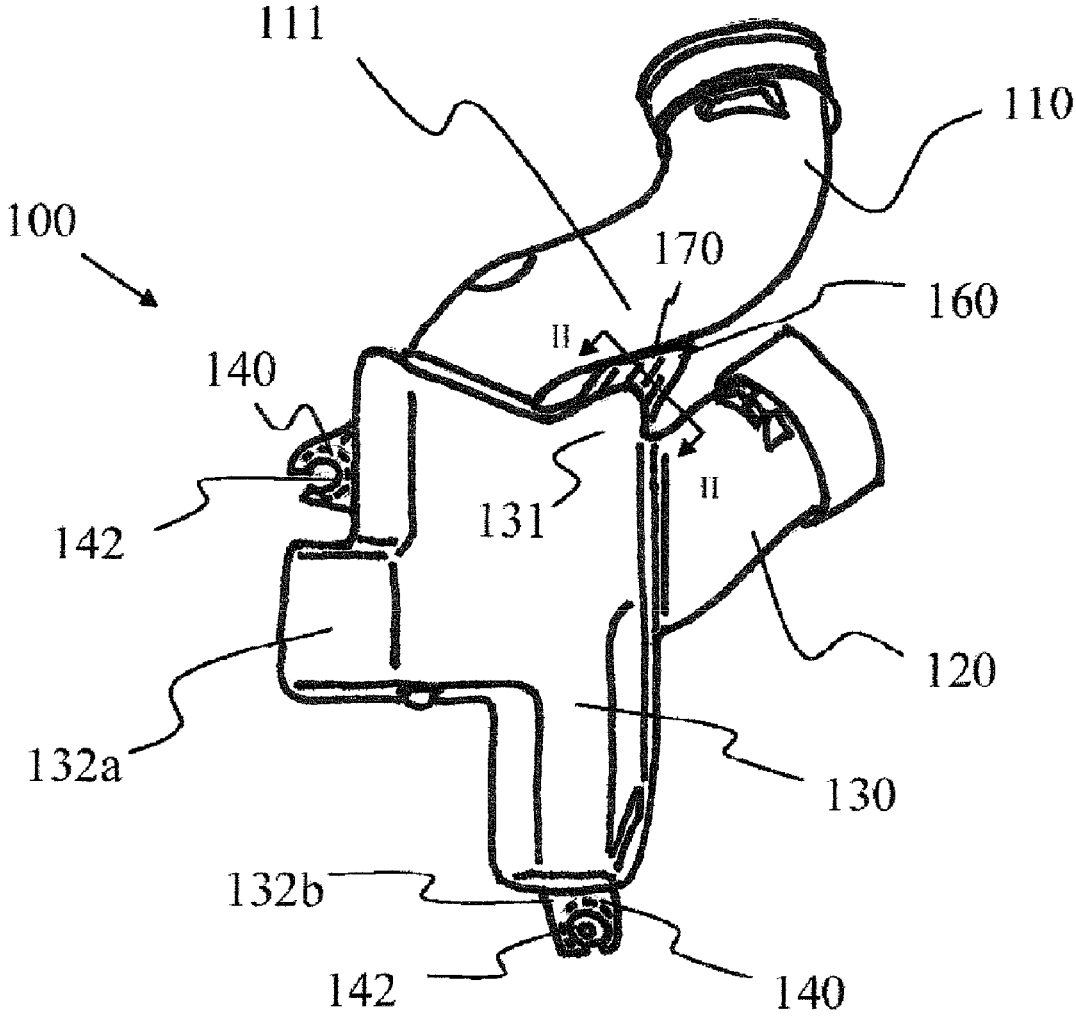
FIG. 1 illustrates a perspective view of an exemplary resonator assembly made in accordance with principles of the disclosed subject matter.

Referring to the drawing figures, like reference numerals designate identical or corresponding elements throughout the several figures.

FIG. 1 illustrates a perspective view of an exemplary embodiment of a resonator assembly 100 made in accordance with principles of the disclosed subject matter. The resonator assembly 100 can include a resonator chamber 130 that is connected to both an intake tube 110 and an exhaust or outlet tube 120. The resonator chamber 130 can include a plurality of mounts 140 and corresponding attachment structures 142 for mounting the chamber 130 within the vehicle, for example, to the engine, vehicle frame, or other vehicle component. The extension mounts 140 are configured to receive the attachment structure 142, such as a bolt, screw, clamp, etc. The attachment structure 142 can be attached to a portion of the vehicle frame, the vehicle engine, or other appropriate mounting structure located in the vehicle, while the mounts 140 can be integrally formed with/in the resonator chamber 130.

The resonator chamber 130 can be configured as a two piece structure including an upper portion 132*a* and a lower portion 132*b* that mate together to form the chamber 130. The two piece construction facilitates attachment to various structures, including an intake tube 110 and an exhaust or outlet tube 120. Moreover, the upper portion 132*a* and lower portion 132*b* can be assembled together to lock a respective end of each of the intake tube 110 and exhaust or outlet tube 120 in the chamber 130 by sandwiching the tubes 110 and 120 between the upper portion 132*a* and lower portion 132*b* of the resonator chamber 130. The mounts 140 can be solely formed in the lower portion 132*b* of the resonator chamber 130. The upper portion 132*a* of the resonator chamber 130 can be clipped in place and then hot plate welded to the lower portion 132*b* of the resonator chamber 130. Alternatively, the mounts 140 can comprise upper and lower portions that each extend from respective upper and lower portions 132*a* and 132*b* of the resonator chamber 130 and which sandwich the attachment structure 142 therebetween.

In the embodiment shown in FIG. 1, the intake tube 110 extends away from the resonator chamber 130 and then angles back via a bend 111 in the intake tube 110 towards an adjacent retainer portion 131 of the resonator chamber 130. An extension 170 can be formed in or attached to the tube 110 at the bend 111 facing towards the resonator chamber 130 and, more particularly, towards the retainer portion 131 of the resonator chamber 130. The retainer portion 131 of the resonator chamber 130 includes a tube attachment structure 160 that mates with the extension 170 to hold the intake tube 110 in place with respect to the resonator chamber 130. The attachment structure 160 will be described in more detail below.

Figure 2:
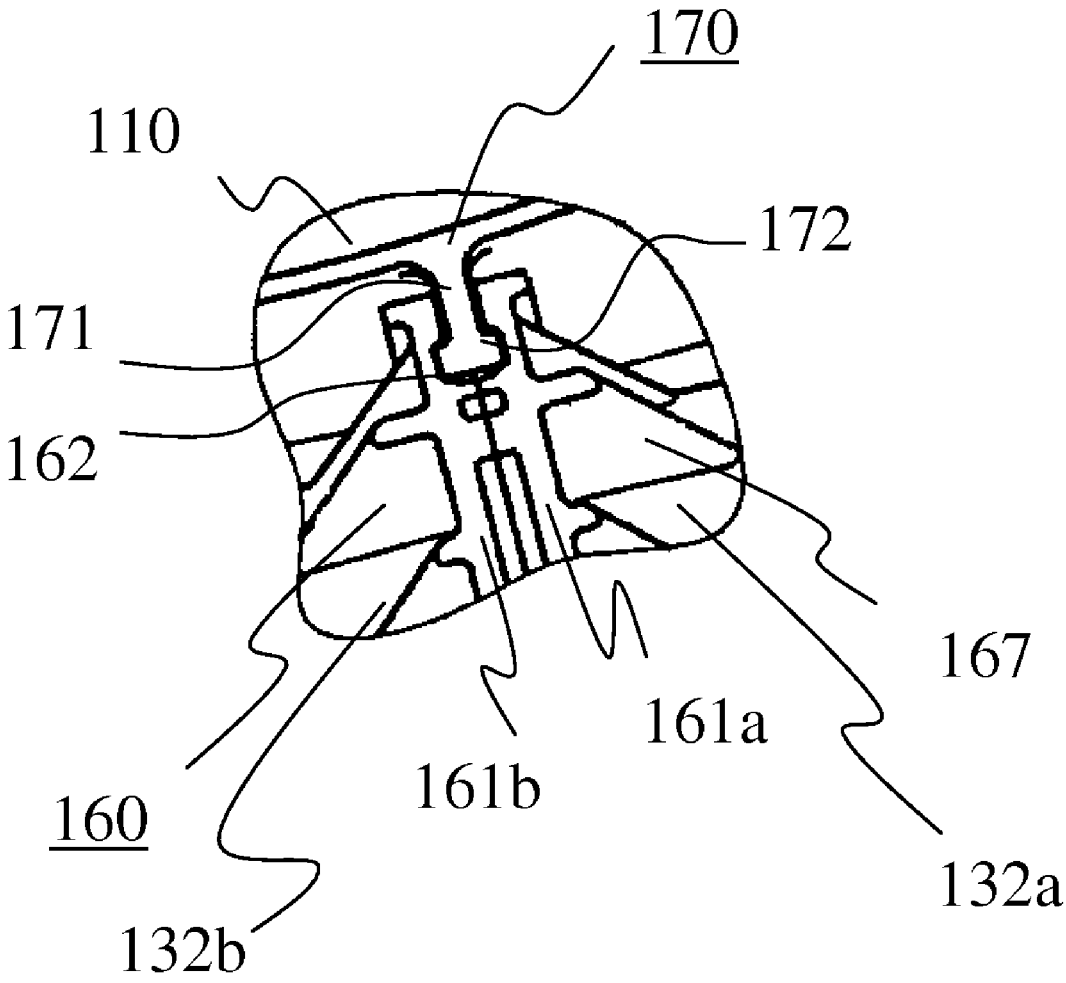
FIG. 2 illustrates a detailed cross-section view taken along line II-II of FIG. 1.
Figure 3A:
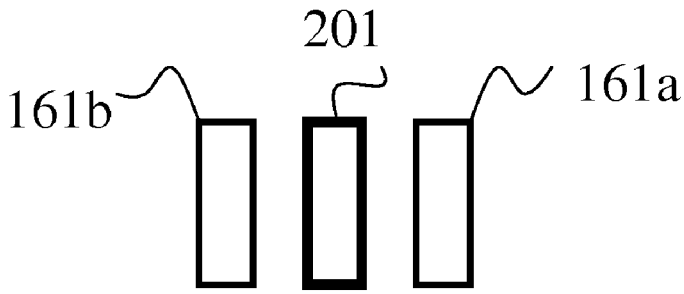
FIGS. 3(*a*)-(*e*) are schematic diagrams showing an example of a method for attaching a resonator to a tube in accordance with principles of the presently disclosed subject matter.
Figure 3B:
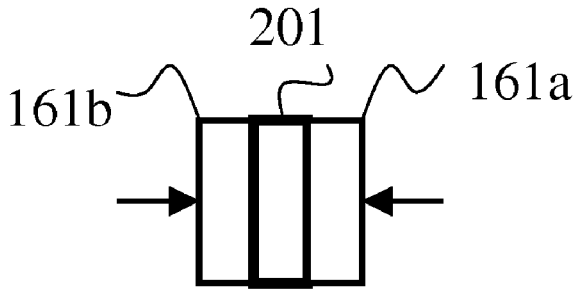
Figure 3C:
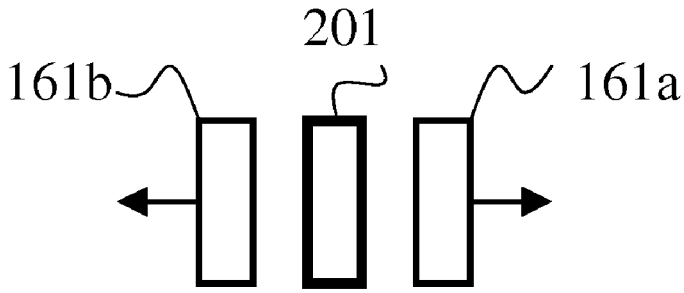
Figure 3D:
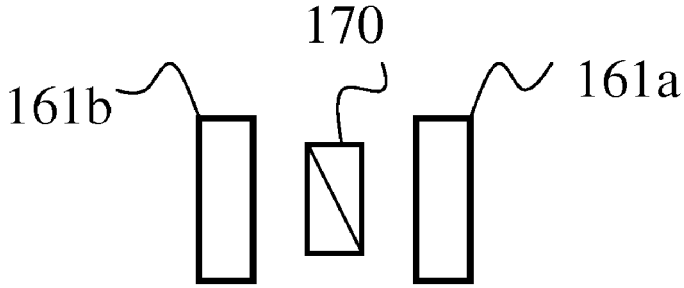
Figure 3E:
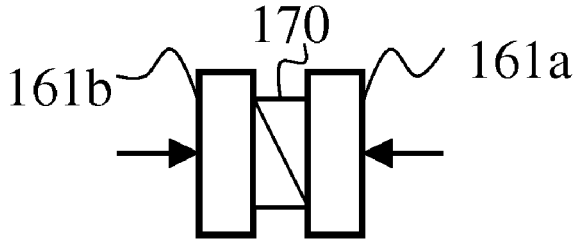

FIG. 2 shows a detailed cross section taken along line II-II of FIG. 1. As can be seen in this embodiment, the resonator chamber 130 is formed by an upper portion 132*a* that includes a tube mount upper half 161*a* extending therefrom, and a mating lower portion 132*b* that includes a tube mount lower half 161*b* extending therefrom. The upper and/or lower mount halves 161*a* and 161*b* can include a plurality of fins 167 molded therein to provide heat conduction during the welding processes, such as hot plate welding, of the assembly. The welding processes will be described in more detail below.

A cavity 162 can be formed between an outer portion of the tube mount upper half 161*a* and tube mount lower half 161*a* of the resonator chamber 130. The cavity 162 can be shaped to mate with a lock structure 172 located at an outermost portion of the extension 170 located at the bend portion 111 in the intake tube 110. The lock structure 172 can be configured as a bulbous portion at an end of a stem 171 that together form the extension 170. The stem 171 and lock structure 172 can be configured to mate with the respective cavity 162 formed between the tube mount upper half 161*a* and tube mount lower half 161*b* in the tube attachment structure 160 of the resonator chamber 130. Thus, the intake tube 110 is prevented from vibrating or moving relative to the resonator chamber 130 due to the locking interaction between the extension 170 and the attachment structure 160 as described above, which results in a particularly stable resonator assembly 100.

An embodiment of a method for assembling the resonator assembly 100 will now be described with reference to FIGS. 1-4.

The intake tube 110 and the exhaust or outlet tube 120 can be blow molded, and the extension 170 can be formed in the intake tube 110 by a flash molding process that occurs either during or after the tube blow molding process.

The upper portion 132*a* and mating lower portion 132*b* of the resonator chamber 130 can be formed separately and through various known molding, casting, or even machining techniques and combinations thereof.

As described above, upper portion 132*a* and mating lower portion 132*b* of the resonator chamber 130 can be welded to the extension 170 of the tube 110 to firmly secure the tube 110 with respect to the resonator chamber 130. One process that can be utilized to achieve the weld is described as hot plate welding. Hot plate welding uses a heated platen (or plate) to melt the joining surfaces of the two halves of a thermoplastic part. The halves are brought into contact with the precisely heated platen for a predetermined period of time. After the plastic interfaces have melted, the platen is removed and the parts are brought together to form a molecular, permanent, and often hermetic bond with each other. A properly designed joint welded under precise process control can equal or exceed the strength of any other part area. Advantages of hot plate welding include precise control of the melt temperature, excellent weld strength, ability to weld large, complex parts, and ease of attaining hermetic seals. The hot plate that is used can be coated with a fluorine-containing resin, etc., to improve efficiency of the weld. In the method of hot plate welding, a projecting seam generally called "bead" is sometimes located on the outside and inside of the weld as a result of the bonding under pressure.

Another type of weld that can be used in conjunction with the disclosed subject matter is known as a friction weld. In friction welding, two subject pieces are placed together at high pressure and can be vibrated or moved with respect to each other to create frictional heat which, in turn, plasticizes each piece and cause the pieces to bond with each other.

As shown in FIGS. 3(*a*)-(*e*), it is contemplated that the extension 170 associated with the tube 110 can be hot plate welded to the upper and lower tube mount halves 161 a,b of the resonator chamber 130 to connect the tube 110 with the resonator chamber 130. FIG. 3(*a*) shows a plate 201 being placed or located between the upper and lower tube mount halves 161*a,b* of the resonator chamber 130. FIG. 3(*b*) shows the upper and lower tube mount halves 161*a,b* of the resonator chamber 130 being pressed against the hot plate 201 until interior opposed surfaces of the upper and lower tube mount halves 161*a,b* of the resonator chamber 130 are heated to a substantially plastic state. FIG. 3(*c*) shows the upper and lower tube mount halves 161*a,b* of the resonator chamber 130 being removed from the hot plate 201. FIG. 3(*d*) shows the hot plate 201 being replaced with the extension 170 of the tube 110. Finally, FIG. 3(*e*) shows the upper and lower tube mount halves 161*a,b* of the resonator chamber 130 being squeezed onto the extension 170 to cause the substantially plasticized upper and lower tube mount halves 161*a,b* to be hot plate welded with the extension 170 located therebetween to lock and weld the extension 170 of tube 110 in place with respect to the resonator chamber 130.

Figure 4:
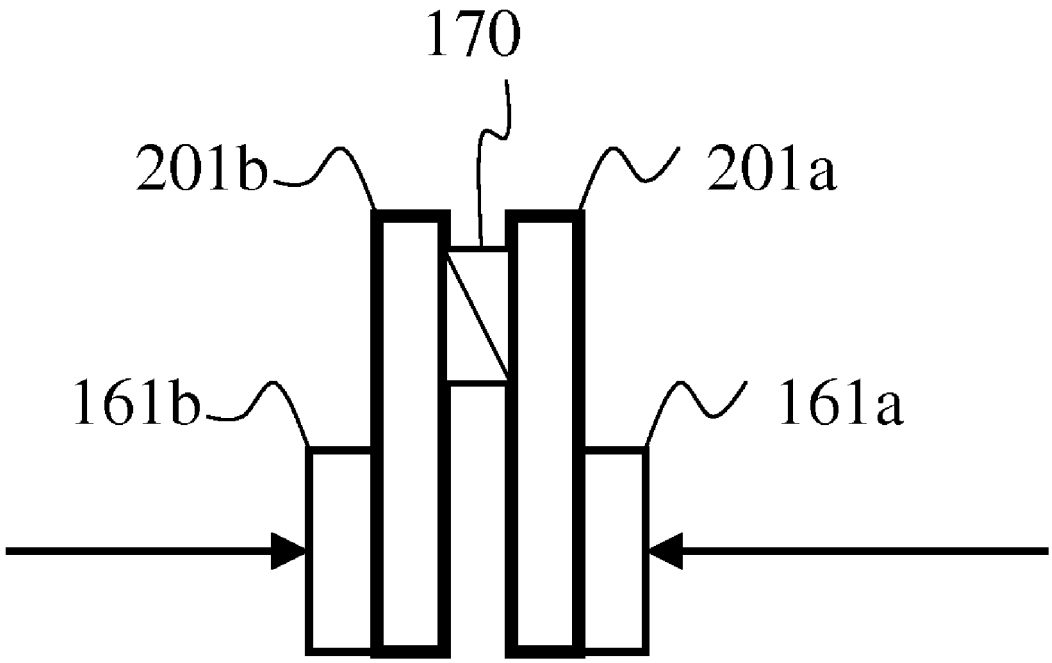
FIG. 4 is a schematic diagram showing an alternative process for attaching a resonator to a tube in accordance with principles of the presently disclosed subject matter.

FIG. 4 shows an alternative process in which two hot plates 201*a* and 201*b* are used to heat all of the upper and lower tube mount halves 161*a,b* of the resonator chamber 130 and the extension 170 simultaneously. In this process, the hot plates 201*a* and 201*b* are removed and the heated structures (the upper and lower tube mount halves 161*a,b* of the resonator chamber 130 and the extension 170) are all then squeezed or otherwise pressed together to form the hot plate weld between the parts.

Alternatively, the upper and lower tube mount halves 161*a,b* of the resonator chamber 130 can be welded to the extension 170 via friction welding by applying pressure or squeezing the parts together and then moving or vibrating them with respect to each other to cause the necessary heat to plasticize the contacting portions and bonding the structures together. Furthermore, some type of spot welding or point welding could be used to bond the upper and lower tube mount halves 161*a,b* of the resonator chamber 130 with the extension 170 of the tube 110.

It should be noted that several of the disclosed structures that make up the resonator assembly 100 can be varied in terms of shape, size, material, connections, etc., without departing from the spirit and scope of the presently disclosed subject matter. For example, the tube 120 could also be welded to the resonator chamber 130 in place of or in addition to the tube 110. Also, although the resonator chamber 130 is shown as being a two piece structure, it could include more structures and can be variously shaped. The resonator chamber 130 can be formed as or include a Helmholtz resonator, expansion chamber or other know resonator type structure. In addition, the resonator assembly 100 can include multiple resonator chambers 130 and/or multiple tubes 110 and 120. In addition, the extension 170 can be located at any convenient point along the tube 110 that is close to the resonator chamber 130, and need not be located at bend 111 in the tube 110. The entire extension 170 is shown as completely spaced from the port at which tube 110 is attached to the resonator chamber 130. However, it is contemplated that the extension 170 could be extrusion molded or otherwise extend from the port along the side of the tube 110 to a point located adjacent the retainer portion 131 of the resonator chamber 130. In this manner, the extension 170 is spaced from the port at the point at which it attaches to the upper and lower tube mount halves 161*a* and *b*.

The above-described methods for manufacturing the resonator assembly 100 can also be varied in many different ways without departing from the spirit and scope of the invention. For example, the sequencing of steps can be re-arranged or made simultaneous. In addition, certain processes can be skipped or added without effecting the overall invention. For example, the heating of the extension 170 need not take place in certain embodiments of the invention to fully realize the disclosed method. Alternatively, the heating of one or both of the upper and lower tube mount halves 161*a, b* need not take place in certain embodiments of the invention to fully realize the disclosed method.

The hot plate can take on various shapes depending on specific applications of the invention. For example, if the extension 170 and the upper and lower tube mount halves 161*a,b* of the resonator chamber 130 are to be heated and/or heated simultaneously, then the hot plate can be separated into two parts (for example, as shown in FIG. 4) to heat all of the structures. However, depending on the specific shape of the upper and lower tube mount halves 161*a,b* of the resonator chamber 130 and the extension 170, the hot plate could be configured as a single piece structure with the ability to heat all parts at one time. Certain chemical agents could also be used to enhance or facilitate the weld between the parts, including certain coatings on the hot plate and certain plasticizing agents on the parts to be welded. In addition, although in hot plate welding the parts generally contact the hot plate weld to facilitate the transfer of heat and subsequent plasticizing of the parts, it is possible that the hot plates could be used in an irradiative manner to heat the parts to be welded. For example, resistance heat coils, IR heat coils, microwave, or inductive heating could be used and directed to the particular surfaces that are to be welded. If inductive heat is to be used, a metal part could be embedded in or otherwise associated with specific portions that are to be heated. In addition, pressure can be applied simply by forcing the parts to be welded together either by squeezing or by top down or bottom up application of pressure. Pressure can be applied using various known means, such as pneumatic pressing devices, electromechanical devices, or even gravity. Fins can be placed in the structures that are to be welded together in order to better direct the heat to portions that are to be welded, and to ensure that those portions that should not be plasticized or melted during the welding process are not plasticized or melted. Specifically, fins can ensure that certain portions of the parts to be welded remain structurally sound so that the application of pressure can be realized and transmitted through the part to that portion of the part that is melted and intended to be welded. The above described alternative processes and structural features are not meant to be exhaustive, but simply exemplary in nature. Many other specific features and characteristics of the apparatus and method disclosed herein fall within the scope of the disclosure.

While the resonator chamber 130 is shown having a distinct retainer portion 131 extending towards the first tube 110, it is contemplated that the retainer portion 131 could simply be a portion of a square or rectangular or other shaped resonator chamber 130 that does not necessarily have specific structural definition of the retainer portion 131 other than an area located close to or adjacent the first tube 110 and from which the upper and lower tube mount halves 161*a* and *b* extend. Also, the mounts 140 and attachment structures 142 could be replaced with wholly separate clips or other attachment structure, and the resonator chamber 130 could be molded without any mounts 140 formed therein.

While the invention has been described in detail with reference to exemplary embodiments thereof, it will be apparent to one skilled in the art that various changes can be made, and equivalents employed, without departing from the scope of the invention. The foregoing description of embodiments of the invention has been presented for purposes of illustration and description. It is not intended to be exhaustive or to limit the invention to the precise form disclosed, and modifications and variations are possible in light of the above teachings or may be acquired from practice of the disclosed subject matter. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A resonator assembly for an air intake system of a vehicle, comprising:

a resonator chamber that includes a main body, a first port, a second port, a retainer portion of the main body, and a tube mount upper half and a tube mount lower half extending from the retainer portion of the main body;

a first tube extending from the first port of the resonator chamber and including a first end and a second distal end located away from the first end, the first tube including an extension structure extending from a side surface of the first tube and spaced from the first port of the resonator chamber;

a second tube extending from the second port of the resonator chamber; and an attachment weld portion located between the retainer portion and the first tube, wherein the attachment weld portion includes portions of the tube mount upper half, tube mount lower half, and the extension structure of the first tube which are all in contact with each other at the weld portion to form a bond between each other, the attachment weld portion being spaced from the first port of the resonator chamber.

2. The resonator assembly for an air intake system of a vehicle according to claim 1, wherein the resonator chamber main body includes an upper half and a separate lower half that is attached to the upper half to form the chamber.

3. The resonator assembly for an air intake system of a vehicle according to claim 2, wherein the tube mount upper half extends from the resonator chamber main body upper half, and the tube mount lower half extends from the resonator chamber main body lower half.

4. The resonator assembly for an air intake system of a vehicle according to claim 1, wherein the extension structure includes a lock structure having a stem portion and a bulbous portion, and the tube mount upper half and tube mount lower half form a cavity in which the bulbous portion is located.

5. The resonator assembly for an air intake system of a vehicle according to claim 1, wherein the extension structure is flash molded and the first tube is blow molded.

6. The resonator assembly for an air intake system of a vehicle according to claim 1, wherein the resonator chamber includes a Helmholtz resonator structure.

7. The resonator assembly for an air intake system of a vehicle according to claim 1, wherein the resonator chamber includes a plurality of mounts configured for securing the resonator assembly within the vehicle.

8. The resonator assembly for an air intake system of a vehicle according to claim 1, wherein the first tube includes a bend portion that extends towards the retainer portion of the main body, and the extension structure extends from the bend portion towards the resonator chamber main body.

9. The resonator assembly for an air intake system of a vehicle according to claim 1, wherein the tube mount upper half and tube mount lower half each include a plurality of fins configured to dissipate heat during a welding process.

10. The resonator assembly for an air intake system of a vehicle according to claim 1, wherein the entire extension structure is spaced from the first port.

11. A method for securing a first tube to a resonator chamber in an air intake system for a vehicle, comprising:

providing a resonator chamber that includes a main body, a first port, a retainer portion, and a tube mount upper half and a tube mount lower half extending from the retainer portion of the main body;

providing a first tube including a first end configured to be connected to the first port located in the resonator chamber, a second distal end located away from the first end, and an extension structure spaced from the first port of the resonator chamber when the first tube is connected to the first port;

heating at least one of the tube mount upper half, the tube mount lower half, and the extension structure;

locating the extension structure of the first tube in between the tube mount upper half and tube mount lower half;

applying pressure on at least one of the tube mount upper half, the tube mount lower half, and the extension structure to cause a weld to occur between at least one of the tube mount upper half, the tube mount lower half, and the extension structure.

12. The method for securing a first tube to a resonator chamber in an air intake system for a vehicle of claim 11, wherein heating includes pressing a heated plate against at least one of the tube mount upper half, the tube mount lower half, and the extension structure, to cause the weld to occur between at least one of the tube mount upper half, the tube mount lower half, and the extension structure.

13. The method for securing a first tube to a resonator chamber in an air intake system for a vehicle of claim 11, further comprising:

locating a heating plate between the tube mount upper half and the tube mount lower half to heat adjoining surfaces of the tube mount upper half and the tube mount lower half;

removing the heating plate from between the tube mount upper half and the tube mount lower half; and locating the extension structure between the tube mount upper half and the tube mount lower half, wherein applying pressure includes causing the tube mount upper half and the tube mount lower half to squeeze the extension structure therebetween to cause a hot plate weld to occur between at least two of the tube mount upper half, the tube mount lower half, and the extension structure.

14. The method for securing a first tube to a resonator chamber in an air intake system for a vehicle of claim 13, further comprising:

locating the heating plate against the extension structure.

15. The method for securing a first tube to a resonator chamber in an air intake system for a vehicle of claim 11, wherein heating includes heating all of the tube mount upper half, the tube mount lower half, and the extension structure.

16. The method for securing a first tube to a resonator chamber in an air intake system for a vehicle of claim 11, further comprising:

locating a heating plate against the extension structure.

17. The method for securing a first tube to a resonator chamber in an air intake system for a vehicle of claim 11, wherein the extension structure is located between the first end and second distal end of the first tube.

18. A resonator assembly for an air intake system of a vehicle, comprising:

a resonator chamber that includes a main body, a first port, a retainer portion of the main body, and a tube mount upper half and a tube mount lower half extending from the retainer portion of the main body;

a first tube extending from the first port of the resonator chamber and including a first end connected to the first port of the resonator chamber and a second distal end located away from the first end, the first tube including an extension structure extending from a side surface of the first tube and spaced from the first port of the resonator chamber; and an attachment weld portion located between the retainer portion and the first tube, wherein the attachment weld portion includes portions of the tube mount upper half, the tube mount lower half, and the extension structure of the first tube which are melted together to form a bond between each other, the tube mount upper half and tube mount lower half being hot plate welded together with the extension structure therebetween to encapsulate a portion of the extension structure between the tube mount upper half and tube mount lower half.

19. The resonator assembly for an air intake system of a vehicle according to claim 18, wherein the resonator chamber main body includes an upper half and a separate lower half that is attached to the upper half to form the chamber.

20. The resonator assembly for an air intake system of a vehicle according to claim 18, wherein the tube mount upper half extends from the resonator chamber main body upper half, and the tube mount lower half extends from the resonator chamber main body lower half.

* * * * *